US007017498B2

(12) United States Patent
Berg et al.

(10) Patent No.: US 7,017,498 B2
(45) Date of Patent: Mar. 28, 2006

(54) MULTI-PURPOSE UNIVERSAL SIDEFRAME FOR RAILWAY TRUCKS

(75) Inventors: Thomas R. Berg, St. Louis, MO (US); Nathan J. Reese, Troy, IL (US); Jeffrey M. Ruback, Edwardsville, IL (US)

(73) Assignee: ASF-Keystone, Inc., Granite City, IL (US)

( * ) Notice: Subject to any disclaimer, the term of this patent is extended or adjusted under 35 U.S.C. 154(b) by 0 days.

(21) Appl. No.: 10/856,830

(22) Filed: Jun. 1, 2004

(65) Prior Publication Data

US 2004/0261651 A1 Dec. 30, 2004

Related U.S. Application Data

(60) Provisional application No. 60/482,131, filed on Jun. 25, 2003.

(51) Int. Cl.
*B61F 3/00* (2006.01)

(52) U.S. Cl. ..... 105/206.1

(58) Field of Classification Search ..... 105/157.1, 105/182.1, 193, 200, 226, 230, 206.1
See application file for complete search history.

(56) References Cited

U.S. PATENT DOCUMENTS 6,089,166 A * 7/2000 Callahan et al. ..... 105/226
6,354,226 B1 * 3/2002 Stecker ..... 105/226
6,371,033 B1 * 4/2002 Smith et al. ..... 105/157.1
6,425,334 B1 * 7/2002 Wronkiewicz et al. .. 105/198.4

* cited by examiner

*Primary Examiner*—S. Joseph Morano
*Assistant Examiner*—Robert J. McCarry, Jr.
(74) *Attorney, Agent, or Firm*—Oliff & Berridge, PLC; Edward J. Brosius

(57) ABSTRACT

An improved sideframe has a bolster opening configured to accept a variety of spring group and friction shoe assembly designs. The bolster opening is defined by a bottom section, a top compression member, and two opposing column members and has two column wear plates each secured to the opposing column members. The bottom section of the bolster opening defines a spring seat. The dimensions of the bolster opening of the sideframe allow for a variety of freight car truck suspension systems including the spring group, bolster and friction shoe used therewith.

18 Claims, 13 Drawing Sheets

44
38
40
16
32
62
15
36
13
12

58
60
61
63
32

MULTI-PURPOSE UNIVERSAL SIDEFRAME FOR RAILWAY TRUCKS

CROSS-REFERENCE TO RELATED APPLICATIONS

This nonprovisional application claims the benefit of U.S. Provisional Application No. 60/482,131, filed Jun. 25, 2003.

BACKGROUND OF THE INVENTION

1. Field of Invention

The present invention relates to an improved sideframe in a wheel-truck assembly for supporting a railcar, the sideframe having a bolster window opening that accommodates various truck suspension designs.

2. Description of Related Art

The opposed ends of a railcar body are commonly supported on spaced-apart wheel-truck assemblies for travel along a railway track. A standard railcar wheel-truck assembly generally has a laterally spaced pair of sideframes which are longitudinally operable along the tracks and parallel to the longitudinal axis of the railcar. The sideframes are positioned parallel to the direction of travel of the wheels and to the rails. A bolster, which is transversely positioned to the longitudinal direction of the railcar, couples the sideframes and has the car body supported on bolster center plate sections.

Each sideframe is usually a single casting comprised of an elongated member which has pedestal jaws on each end. The jaws are adapted to receive wheel axles which extend transversely between the spaced sideframes. A bolster opening, or window, formed in the sideframe receives the truck bolster. The bolster is typically constructed as single cast steel section and each end of the bolster extends into each of the sideframe bolster openings. Each end of the bolster is then supported by a spring group that rests on a horizontal extension plate projecting from the bottom of the bolster opening.

The bolster opening, or window, and the spring groups supporting the bolster, allow bolster movement relative to the sideframe. Movement of the bolster relevant to the sideframe may be caused by, for example, railway track conditions, movement of the car body, and the like.

Railway track conditions can include rail running surface variations or discontinuities from differential settling of track on its ballast, rail wear, corrugations, rail misalignment, worn switch frogs or misaligned switch points, as well as the intersection of rails for flange clearance, switches where switching points match with running rails, and rail joints. During normal railcar usage or operation, these and other variations can result in wheel-truck oscillations, which may induce the railcar body to bounce, sway, rock or engage in other unacceptable motions. Wheel-truck movements transferred through the suspension system may reinforce and amplify the uncontrolled motions of the railcar from track variations, which action may result in wheel-truck unloading, and a wheel or wheels of the truck may lift from the track.

The Association of American Railroads (AAR) establishes the criteria for railcar stability, wheel loading and spring group structure. These criteria are set or defined in recognition that railcar body dynamic modes of vibration, such as rocking of sufficient magnitude, may compress individual springs of the spring group at alternate ends of the bolster, even to a solid or near-solid condition. This alternate-end spring compression is followed by an expansion of the springs, which action-reaction can amplify and exaggerate the "apparent" wheel loading on the suspension system and subsequent rocking motion of the railcar, as opposed to the actual or "average" weight or load from the railcar and therein. As a consequence of the amplified rocking motion, and at large amplitudes of such rocking motion, the contact force between the rails and the wheels can be dramatically reduced on the alternate lateral sides of the railcar. In an extreme case, the wheels can elevate and misalign from the track, which enhances the opportunity for a derailment.

There are various modes of motion of a railcar body, that is bounce, pitch, yaw, and lateral oscillation, and roll. In car body roll, or twist and roll as defined by the AAR, the car body appears to be alternately rotating in the direction of either lateral side and about a longitudinal axis of the railcar. Car body pitch can be considered a forward to rearward rotational motion about a transverse railcar axis of rotation, such that the railcar may appear to be lunging between its forward and reverse longitudinal directions. Car body bounce refers to a vertical and linear motion of the railcar. Yaw is considered a rotational motion about a vertical axis extending through the railcar, which gives the appearance of the car ends moving to and fro as the railcar moves down a track. Finally, lateral stability is considered an oscillating lateral translation of the car body. Alternatively, truck hunting refers to a parallelogramming or warping of the railcar truck, not the railcar body, which is a separate phenomena distinct from the railcar body motions noted above. All of these motion modes are undesirable and can lead to unacceptable railcar performance, as well as contributing to unsafe operation of the railcar.

The spring group arrangements support the railcar and damp the relative interaction between the bolster and sideframe. Each spring group typically includes a plurality of coil springs extending between a sideframe spring seat portion (i.e., bottom of the bolster opening) and an undersurface of the bolster end spaced above the respective sideframe spring-seat. There have been numerous types of spring groups utilized for railcar suspension systems, such as concentric springs within the spring group; five, seven and nine spring arrangements; elongated springs (for use with a friction shoe); and, short spring-long spring combinations (for use with a friction shoe) within the multi-spring set. These are just a few of the many noted spring arrangements that have been positioned between sideframe and bolster end assemblies. These spring assemblies must conform to standards set by the AAR, which prescribes a fixed spring height for each coil spring at the fully-compressed or solid spring condition. The particular spring arrangement for any railcar is dependent upon the physical structure of the railcar, its rated weight-carrying capacity and the structure of the wheel-truck assembly. That is, the spring group arrangement must be responsive to variations in the track as well as in the railcar such as the empty railcar weight, the laden-to-capacity railcar weight, railcar weight distribution, railcar operating characteristics, available vertical space between the sideframe spring-platform and the bolster end, the specific friction shoe design and, other operating and physical parameters. Accordingly, different spring group arrangements may be required for different railcar designs and/or operating conditions including empty railcar weight, railcar size, railcar weight distribution and the like.

In addition to the spring group arrangements, a friction shoe assembly may be utilized to help control the dynamic responses of railcar trucks by providing bolster-to-sideframe damping. Friction shoes include a friction wedge in a bolster pocket (an opening in the bolster end coupling the sideframe), which wedge is biased to maintain frictional engagement with the sideframe. Friction shoes dissipate suspension system energy by frictionally damping relative motion between the bolster and sideframe.

Winged friction shoes are most generally utilized with the friction shoe wings contacting complementary inner surfaces of the bolster pockets. A retention or control spring, which biases the friction shoe and maintains it against the bolster pocket surface and the sideframe column wear surface, is supported by the horizontal extension plate, or spring seat, of the sideframe bolster opening beneath the friction shoe.

Generally, different spring group arrangements and, if necessary, friction shoe assemblies require different sideframe structures with differently sized bolster windows therein that accommodate the different spring group arrangements and friction shoe assemblies. For example, one sideframe designed and manufactured by ASF-Keystone, has column wear plates with a 0.375 inch thickness, a 9.44 inch length and a 8.5 inch width. Another sideframe designed by Standard Car Truck Company and manufactured by ASF-Keystone has a 0.5 inch thick column wear plate, a 10.0 inch length and a 10.0 inch width. Yet another sideframe has a 0.5 inch thick column wear plate, a 9.44 inch length and a 7.5 inch width.

Because different spring group arrangements and different shoe assemblies require different sideframe structures with different sized bolster windows therein, additional maintenance, tooling, and increased inventory is required to maintain the various sideframes and suspension systems. Specifically, a spring group arrangement with its corresponding bolster window, when in use, may require maintenance. Springs may need to be replaced and/or repairs may need to be made to the spring group arrangement, shoe, and/or bolster opening. Specific tooling is required for the sideframes, spring group assemblies, friction shoe assemblies, and the like. Each time a decision is made as to which parts to replace and/or repair, a potential for errors increases. Further, an increased inventory must be maintained so that the required parts are readily accessible. Accordingly, a multi-purpose universal sideframe with a bolster opening that can accommodate various spring group arrangements and friction shoe assemblies would decrease needed tooling and inventory.

SUMMARY OF THE INVENTION

There is a need for a multi-purpose universal sideframe with a bolster window opening that may accommodate a number of different spring assemblies and/or friction shoe assemblies.

There is also a need for a multi-purpose universal sideframe with a bolster window opening that maintains the same dimensions regardless of which spring assembly and/or friction shoe assembly is used.

There is also a need for a multi-purpose universal sideframe with a bolster window opening that accommodates a number of different spring assemblies and/or friction shoe assemblies such that minimized tooling is required.

There is also a need for a multi-purpose universal sideframe with a bolster window opening that allows for interchangeable parts, thereby decreasing inventory demand.

There is also a need for a multi-purpose universal sideframe with a bolster window opening that decreases maintenance and repair decisions by using the same universal sideframe regardless of the spring group or friction shoe assemblies.

There further is a need for a multi-purpose universal sideframe with a bolster window opening wherein parts are readily and interchangeably replaced because the parts for the universal sideframe are the same regardless of the suspension design.

The above and other advantages are achieved by various embodiments of the invention.

In exemplary embodiments, less tooling is required with a standard bolster window opening that may accommodate a number of spring group configurations and shoe assemblies.

In exemplary embodiments, fewer decisions as to how to maintain or repair parts will be required, and thus the opportunity for error will decrease with a standard bolster window opening that may accommodate a number of spring group configurations and shoe assemblies.

In exemplary embodiments, required inventory will decrease because a standard bolster window opening that may accommodate a number of spring group configurations and shoe assemblies will not require the storing of several different sideframes.

In exemplary embodiments, fewer parts will need to be maintained with a standard bolster window openings.

BRIEF DESCRIPTION OF THE DRAWINGS

The invention will be described with reference to the following drawings, wherein.

DETAILED DESCRIPTION OF PREFERRED EMBODIMENTS

Figure 1:
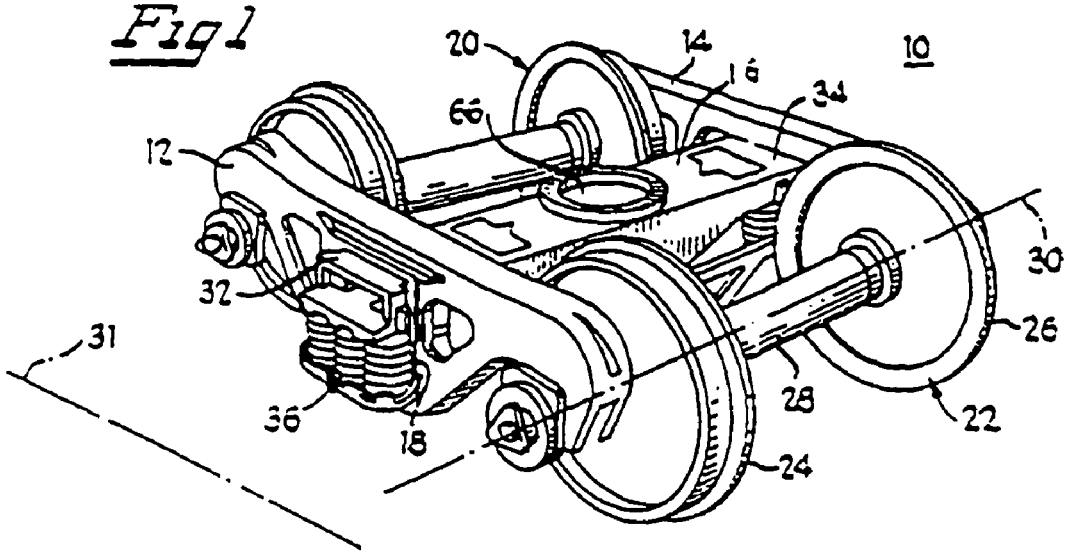
FIG. 1 is an oblique view of a railcar wheel truck assembly.

An exemplary railcar wheel truck assembly 10, as shown in FIG. 1, has a first sideframe 12 and a second sideframe 14, which are arranged in parallel alignment. A transverse bolster 16 couples first and second sideframes 12 and 14 generally at their respective spring windows 18, which windows are located in each of the sideframes at about the longitudinal midpoint of first and second sideframes 12, 14. First axle and wheel set 20 and second axle and wheel set 22 are positioned at the opposed ends of aligned sideframes 12 and 14. Each of first and second axle and wheel set 20, 22 has an axle axis 30 generally transverse to the longitudinal axis 31 of first and second sideframes 12, 14 and about parallel to bolster 16. Each of first and second wheel sets 20, 22 include wheels 24 and 26 and axle 28 with axle axis 30.

Figure 2:
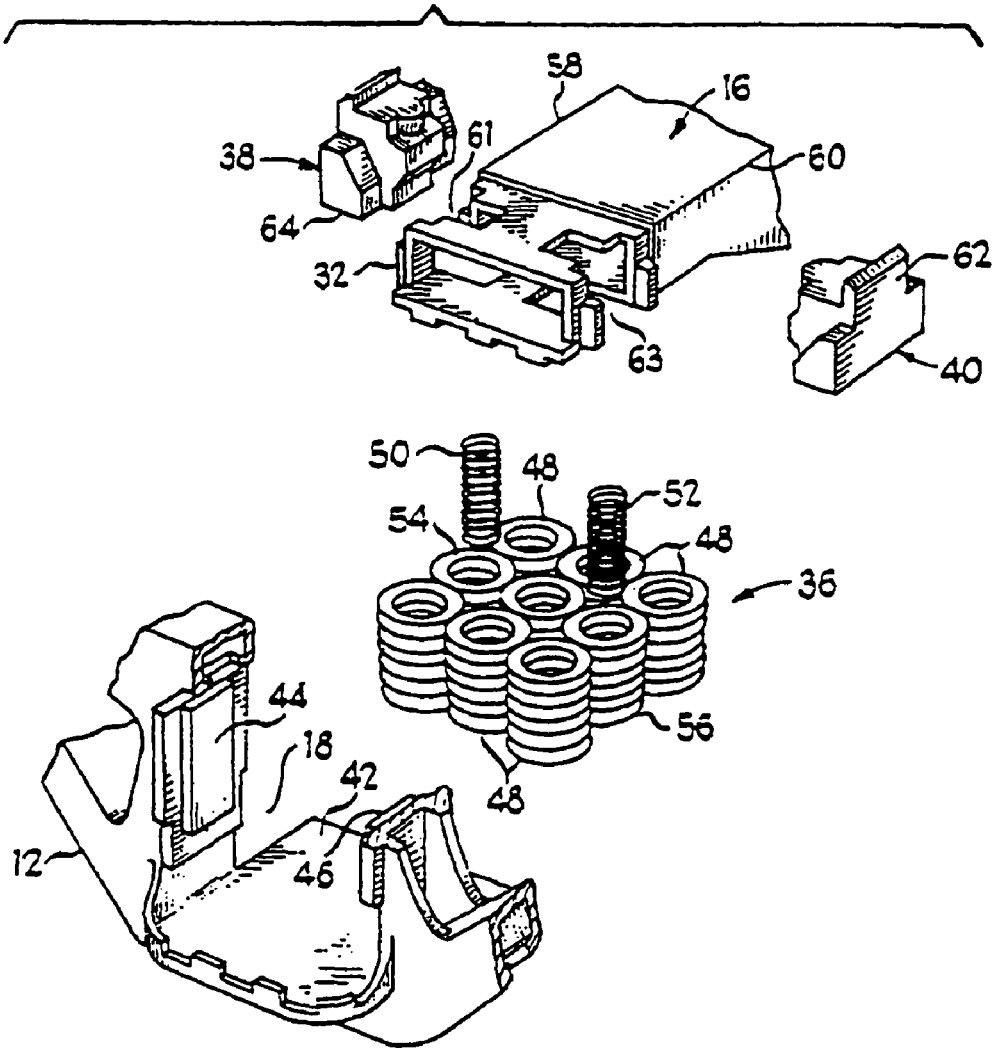
FIG. 2 is an exploded view in partial section of a sideframe, spring group, bolster end and friction shoes at one side of the wheel truck assembly of FIG. 1.

Bolster 16 has first end 32 and second end 34, which respectively extend through windows 18 of first and second sideframes 12 and 14 in FIG. 1. Window 18, bolster end 32, spring group 36, first friction shoe 38 and second friction shoe 40 of sideframe 12 are shown in FIG. 2 in an enlarged, partially sectioned and exploded view. As bolster ends 32 and 34, first and second sideframes 12 and 14, and sideframe windows 18 are structurally and functionally similar, only bolster end 32 at first sideframe 12 will be described, but the description is also applicable to bolster end 34 and window 18 of second sideframe 14.

In FIG. 2, sideframe window 18 has lower support platform 42 with first and second upright side columns or side faces 44 and 46, respectively, extending vertically from platform 42. Spring group 36 is shown as a three by three matrix of load springs 48, 54 and 56. In this matrix, first inner control spring 50 and second inner control spring 52 are concentrically positioned in outer control springs 54 and 56, respectively, to provide control spring subassemblies, which control springs 50, 52, 54 and 56 are also railcar load-bearing elements. Load springs 48, or load spring subassemblies, may include 1, 2 or 3 individual springs concentrically arranged in a manner to meet design criteria or to provide optimum dynamic performance of suspension spring group 36.

The novel sideframe of the present invention includes the sideframe window 18 that is designed to accommodate various spring group designs. For example, the sideframe window 18 is designed to accommodate a 9 outer coil spring group assembly with 1, 2, or 3 individual spring sets. Further, a standard spring group, such as, for example, the spring group 36, may be tuned by changing the number of springs, arrangement of springs, and/or type of springs. Further, the spring group may be modified by the addition of other devices, such as, for example, the addition of hydraulic damping devices, in place of a spring or set of springs thereof within the spring group assembly. Removal of springs involves removing one or more springs of a set of springs within the spring group. Replacement of certain types of springs involves replacing one or more springs of a set of springs or replacing a set of springs within the spring group with a different spring or set of springs of, for example, a spring of different stiffness, size, or the like.

Figure 3:
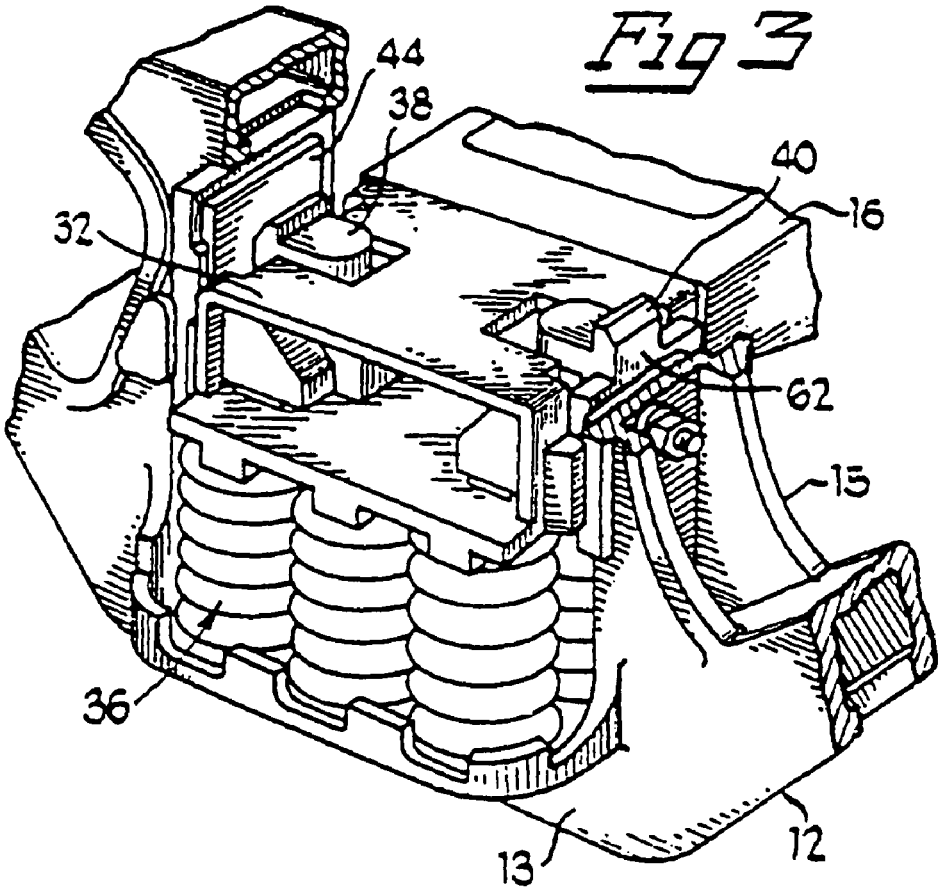
FIG. 3 is an oblique view of the assembled wheel truck assembly section illustrated in FIG. 2.
Figure 4:
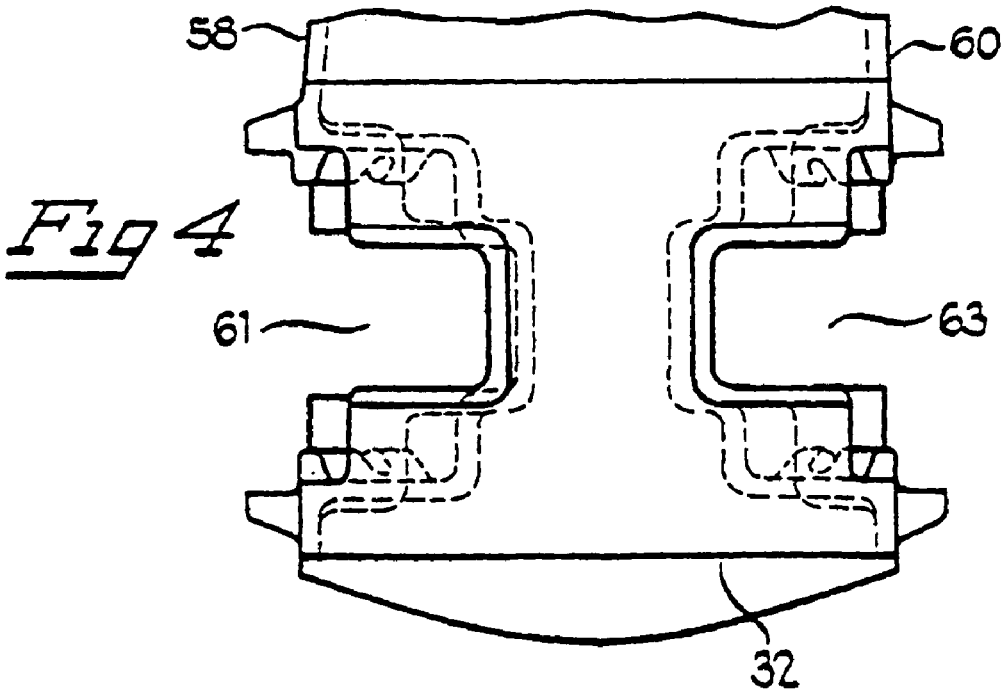
FIG. 4 is a plan view of a bolster end and friction shoe pockets.
Figure 5:
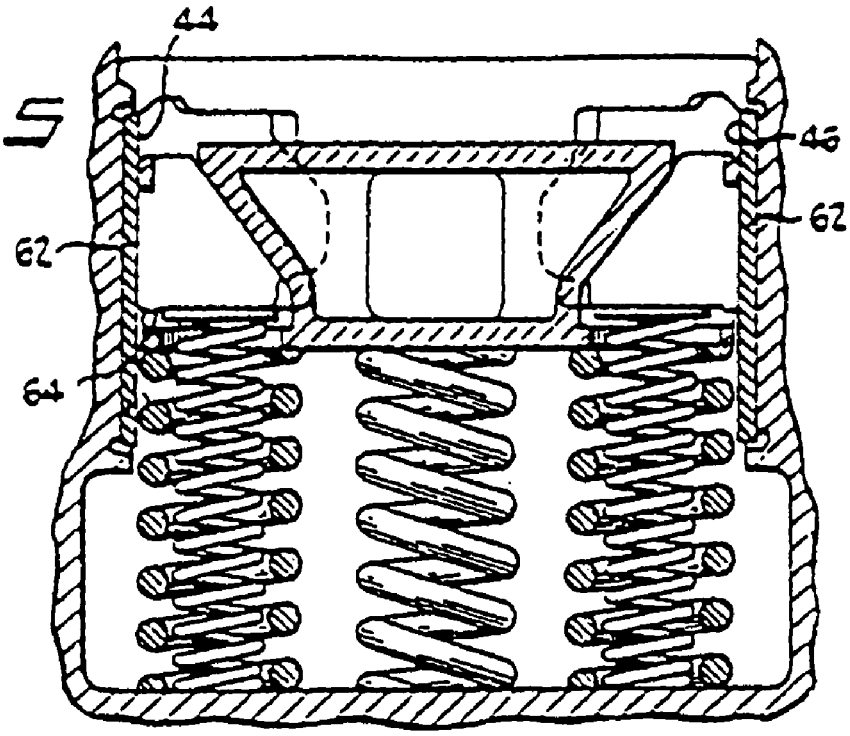
FIG. 5 is an elevational view in section of the spring group, bolster end and friction shoes.

Bolster end 32 in FIGS. 2 and 4 has forward friction shoe pocket 61 at bolster forward edge 58 and rear friction shoe pocket 63 at bolster rear edge 60, which friction shoe pockets 61 and 63 receive first and second friction shoes 38 and 40, respectively, for sliding operation therein. The several elements of sideframe 12, bolster 16 and spring group 36 of FIG. 2 are shown in the assembled form in FIG. 3. In this figure, the interface contact is noted between side column wear face 46 (FIG. 2) and friction face 62 of friction shoe 40. A similar friction face 62 is also present on friction shoe 38 and other friction shoes of wheel trucks. It is the frictional interface action between a friction shoe and a wear face, such as friction shoe 40 and wear face 46, which provides the damping force of the friction shoe. The biasing force applied to friction shoes 38, 40 is provided by control springs 50, 52, 54 and 56, at friction shoe lower surfaces 64, as noted in FIG. 5.

Figure 6:
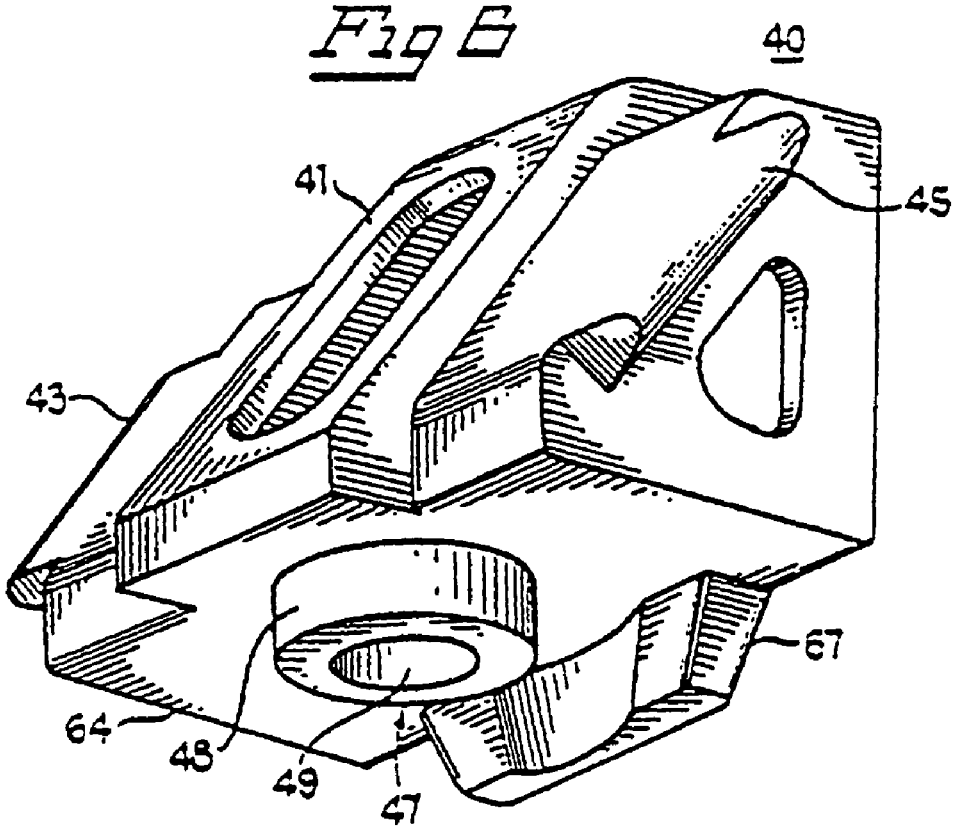
FIG. 6 is a lower elevational oblique view of a friction shoe.

Friction shoes 38, 40 operate as damping devices while sharing the load with the load springs 48. Friction shoe 40 in FIG. 6 is a friction shoe having central portion 41, first wing 43 and second wing 45. Friction shoe central portion 41 is slidably matable with slot 61 or 63 of bolster end 32, as shown in FIG. 4, to maintain friction shoe 40 in position and guide it during its vertical reciprocation as the railcar traverses the rail tracks. However, the biasing operation of control springs, subassemblies or couplets 50, 54 and 52, 56 provide a variable biasing action on their associated friction shoe 38, 40, which accommodates the dynamic operating range of the wheel-truck assembly 10 and car (not shown). In FIG. 6, annular disc or annulus 47, which is generally centrally positioned on lower surface 64, extends from lower surface 64 into control-coil spring 52 to maintain spring 52 in alignment. Spring 52 is in contact with lower shoe surface 64 and biases friction shoe 40 for damping of bolster 12 and truck 10, and thus the railcar.

In normal operation of a railcar, spring group 36 biases bolster 16 and, thus, the railcar is supported by bolster 16 at center plate 66. The biasing force controls or accommodates the oscillations or bouncing of the railcar, maintains railcar stability during traversal of the railcar along the tracks and dampens any perturbations from various indeterminate influences, as noted above.

Alternative non-limiting example structures for the friction shoe and the friction shoe with spring group are noted in FIGS. 7A–7E, 8A and 8B. It should be noted that various friction shoe designs can be used with the railway truck suspension design of the present invention.

Figure 7A:
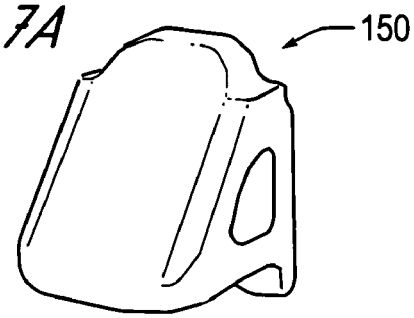
FIG. 7A is an oblique view of an alternate embodiment of a friction shoe.
Figure 7E:
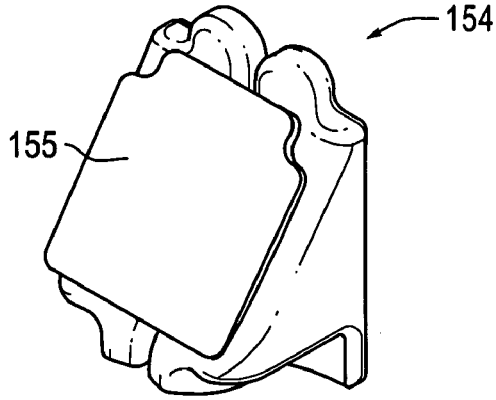
FIG. 7E is an oblique view of the a friction shoe illustrated in FIG. 7D.
Figure 7B:
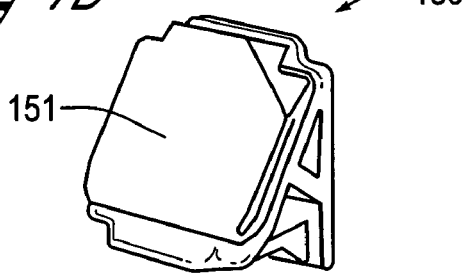
FIG. 7B is an oblique view of an alternate embodiment of a friction shoe.
Figure 7C:
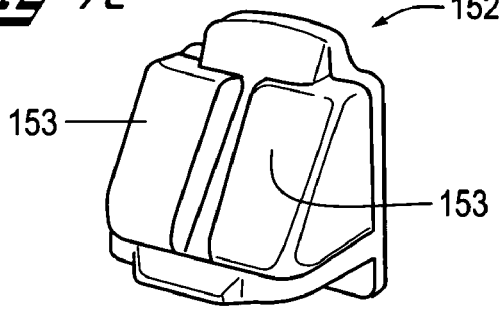
FIG. 7C is an oblique view of an alternate embodiment of a friction shoe.
Figure 7D:
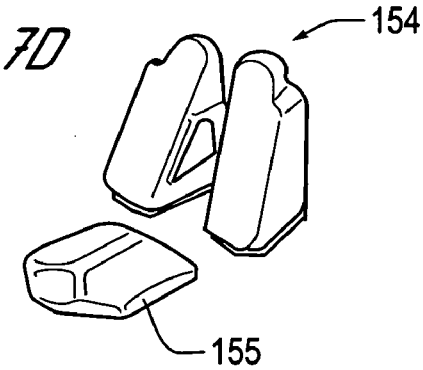
FIG. 7D is an exploded view of an alternate embodiment of a friction shoe.

FIG. 7A illustrates a friction shoe 150 devoid of a double-wing structure. FIG. 7B illustrates the friction shoe 150 with a pad 151. FIG. 7C illustrates an alternate friction shoe 152 with twin pads 153. In FIGS. 7D and 7E, another alternate friction shoe 154 is a split wedge structure having an insert 155.

Figure 8A:
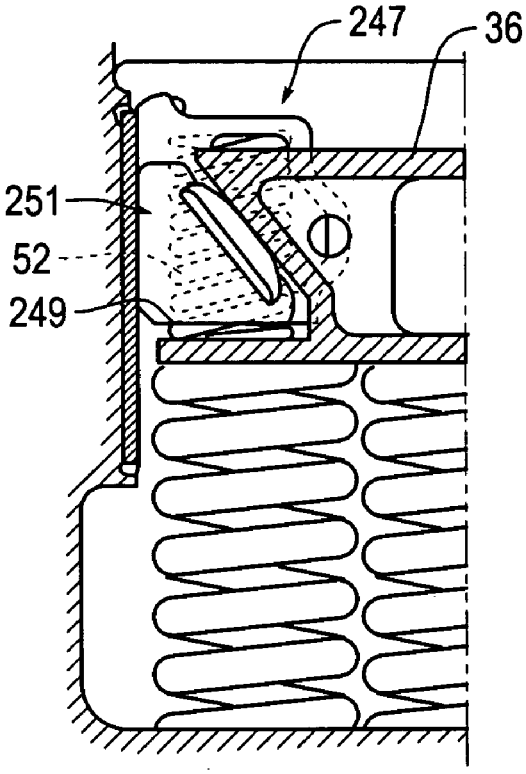
FIG. 8A is an elevational view of a constant bias suspension spring group in a sideframe with a friction shoe.
Figure 8B:
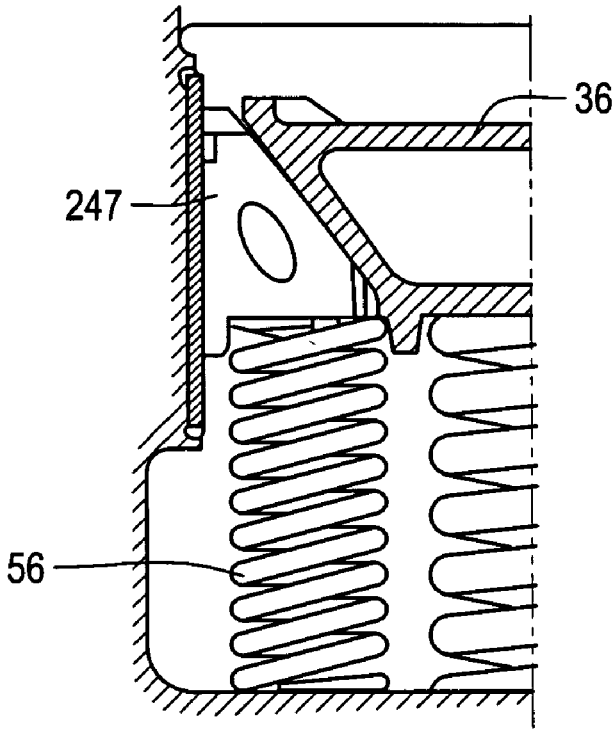
FIG. 8B is an elevational view of a variable bias suspension spring group in a sideframe with a friction shoe.

In FIG. 8A, second alternative friction shoe 247 is noted in an illustrative segment of a constant damped suspension spring group in a sideframe and bolster. In this structure, friction shoe 247 has lower port 249 open to internal chamber 251 of shoe 247. Control spring 52 in chamber 251 biases shoe 247 against bolster 36. In this structure, a friction shoe 247 may have any form, such as a double-winged or single-sloped face. In FIG. 8B, the second alternative friction shoe 247 is noted in an illustrated variable damped suspension spring group of a sideframe and bolster in another embodiment of the present invention.

Figure 9:
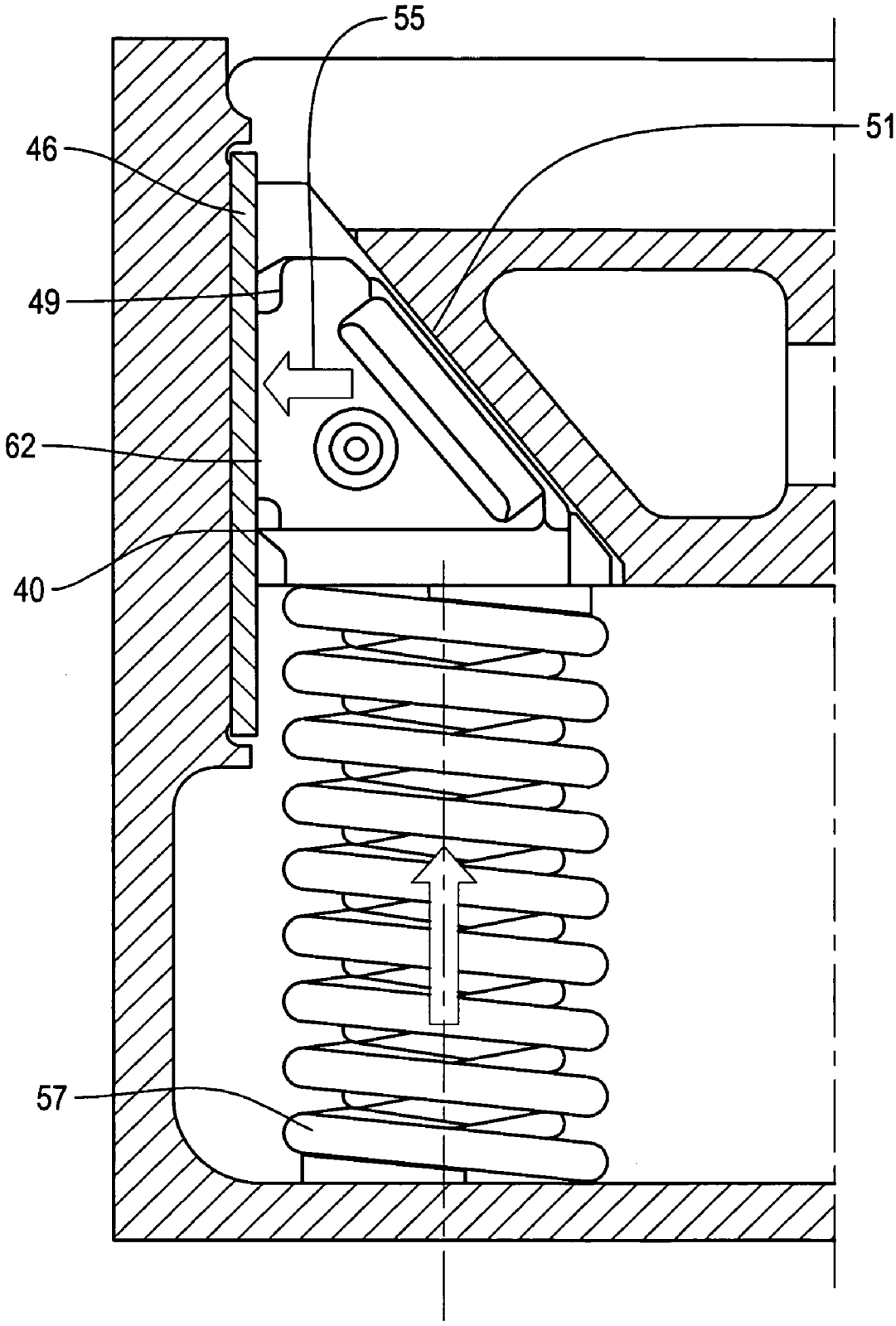
FIG. 9 is an elevational view of a spring group in a sideframe with a friction shoe.

As shown in FIG. 9, typical wear of the elements of the wheel-truck assembly 10 occur on wear face 46, friction face 62, and the friction shoe slope surface 51. Such wear causes the friction shoe to rise within the shoe pocket 63 of the bolster 16. As the friction shoe 40 rises, the control coil 57 decompresses, causing a reduction in column load 55. Therefore, the measurement of the friction shoe height is a comprehensive measure of total control element wear. The friction shoe has a visual indicator 49 to determine when the friction shoe should be replaced based on face wear.

The damping action is frequently applied through apparatus, such as friction shoes 38 and 40, operable at the opposed bolster ends 32, 34 and at each forward and rear edge 58, 60. In addition to the application of a biasing force to bolster end 32, 34 and friction shoes 38, 40, there is an application of the static load (compressive force on the spring), that is, the railcar weight at either an unloaded or fully laden weight of the railcar. However for any particular railcar, the railcar weight is a variable with a broad range extending from an empty-car, vehicle tare weight to a loaded-to-capacity railcar, and perhaps loaded above the rated, vehicle weight. As the railcar traverses the track, it experiences dynamic compressive forces on the springs, and it is susceptible to all the above-cited track conditions as well as countless others, which could contribute to oscillations. Spring group 36 and friction shoes 38, 40 provide the requisite damping to the railcar and wheel-truck assembly 10 for its safe operation.

The structural and operational conflicts between decreased railcar weight and increased carrying capacity is a primary operating condition, which must be accommodated. Further complicating factors include the standards and specifications set by the AAR for railcars utilized in interchange, that is railcars not dedicated to a single user, which thus fall under the aegis of the AAR. The constraining weight factors lead to the operational constraints for the designer. Although the user wishes to maximize railcar carrying capacity while minimizing railcar weight, safe operational characteristics are a prime concern of both the railcar supplier and user.

Indicative of a railcar suspension and damping structure is spring group 36. The spring rate or response for an individual concentric spring arrangement, as well as the number of required springs of various arrangements needed in a specific spring group 36, will vary for a particular wheel-truck assembly 10 and style of railcar. Therefore, by changing the number of springs, arrangement of springs, and/or type of springs for a particular wheel-truck assembly 10 and constraints of the rail car, the riding quality and hunting threshold may be significantly improved.

It should be noted that a number of different coil spring designs are currently used, such as, for example, assemblies including 1) 9 outer springs with 8 inner springs; 2) 7 outer springs with 7 inner springs, 2 inner-inner springs and double control coils; and 3) 7 outer springs with 7 inner springs and double control coils. The 9 coil arrangements are typically used with suspension systems that include constant damped trucks. The 7 coil—double coil arrangements are typically used with suspension systems that include variably damped trucks. Each of these standard coil spring designs may be tuned as discussed above to optimize riding quality and hunting threshold.

The optimal spring group configuration will vary depending on, for example, car length, car weight, and the like. Presently, the spring group configuration is limited to the dimensional constraints of the windows of the sideframe to be used or already in use. Specifically, the diameter, number of springs, and configuration of the springs is limited to the cross-sectional area and shape of the platform as well as the height of the windows and the height of the side faces extending vertically from the platform.

Further, the type of friction shoe used is also limited to the configuration of the windows. By improving the design of the windows, various spring group configurations and/or friction shoes may be accommodated by the same sideframe.

Figure 10A:
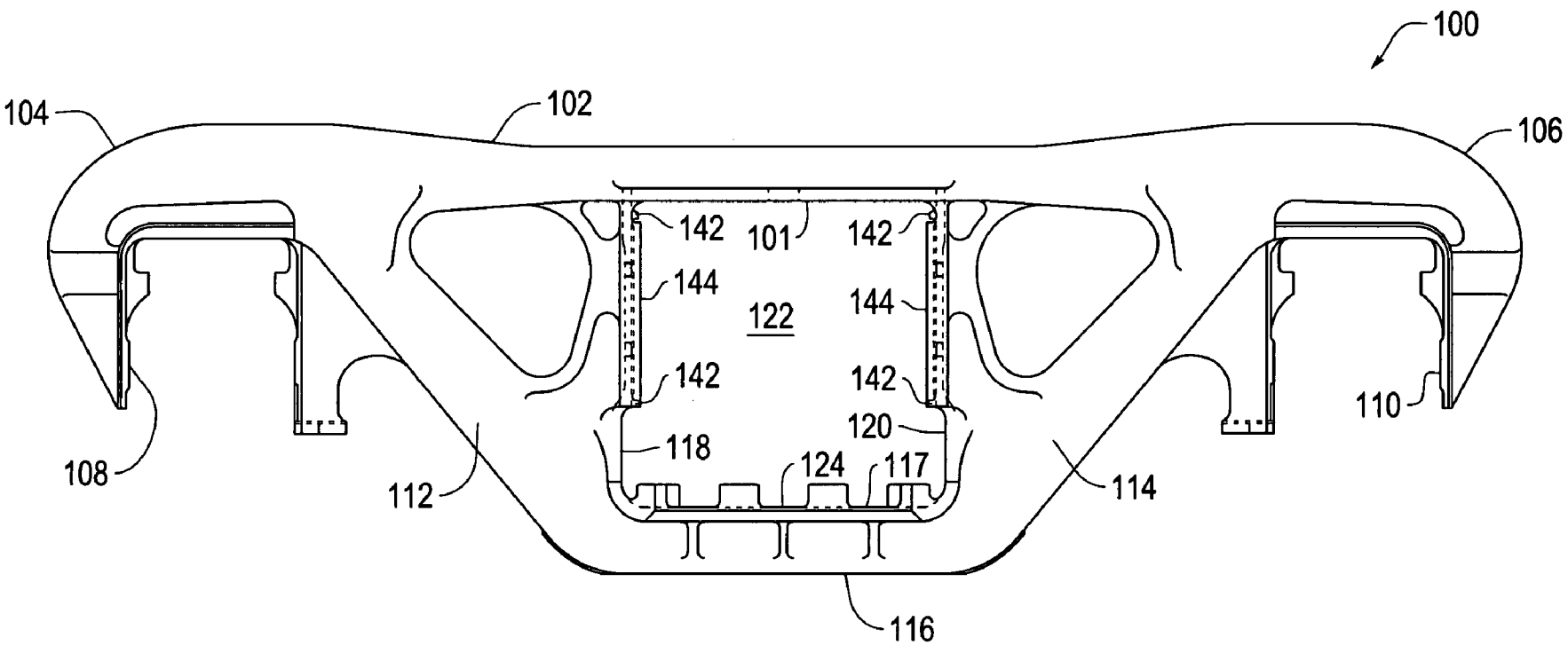
FIG. 10A is a side view of a multi-purpose sideframe.
Figure 10B:
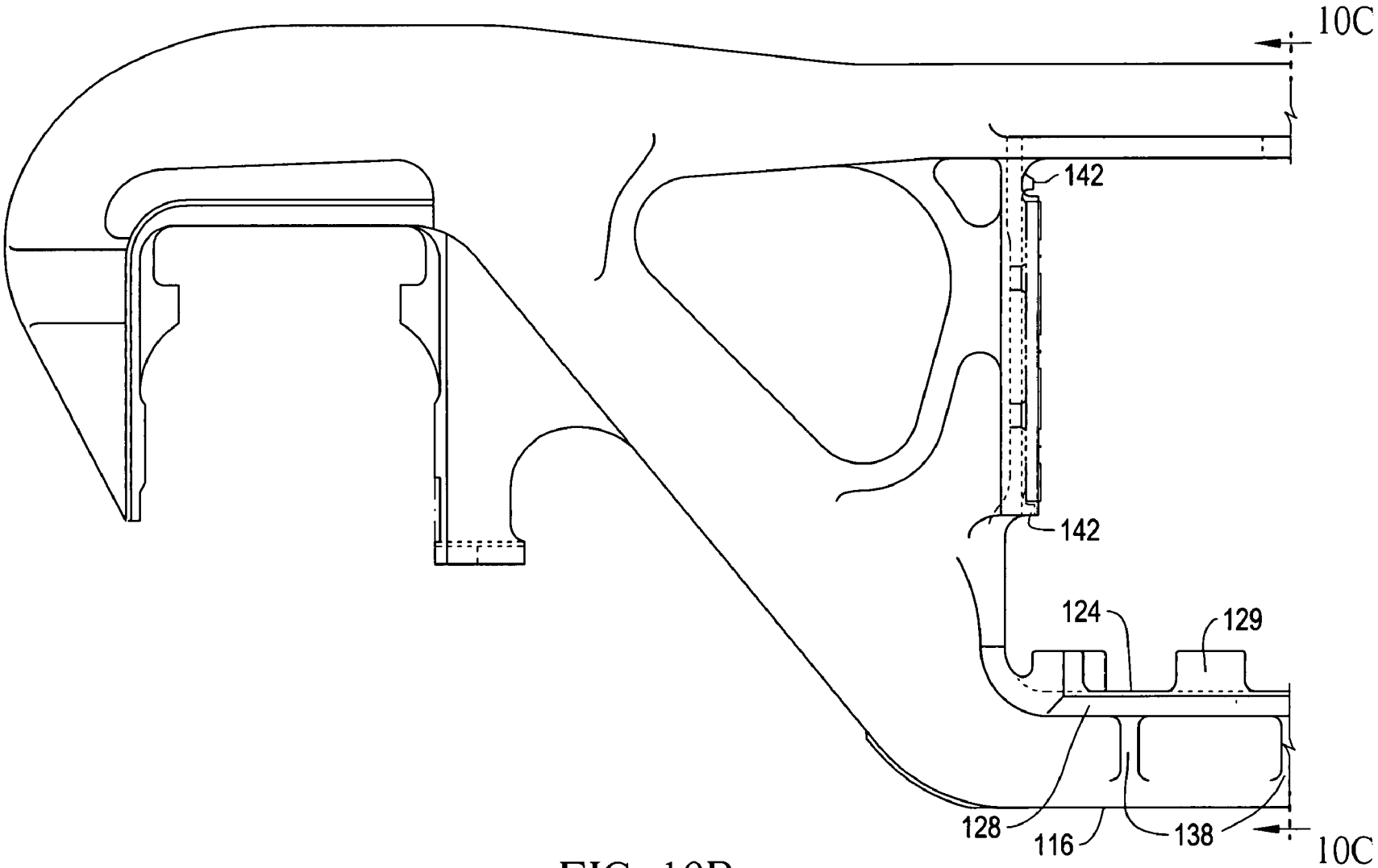
FIG. 10B is a partial side view of a multi-purpose sideframe.
Figure 10D:
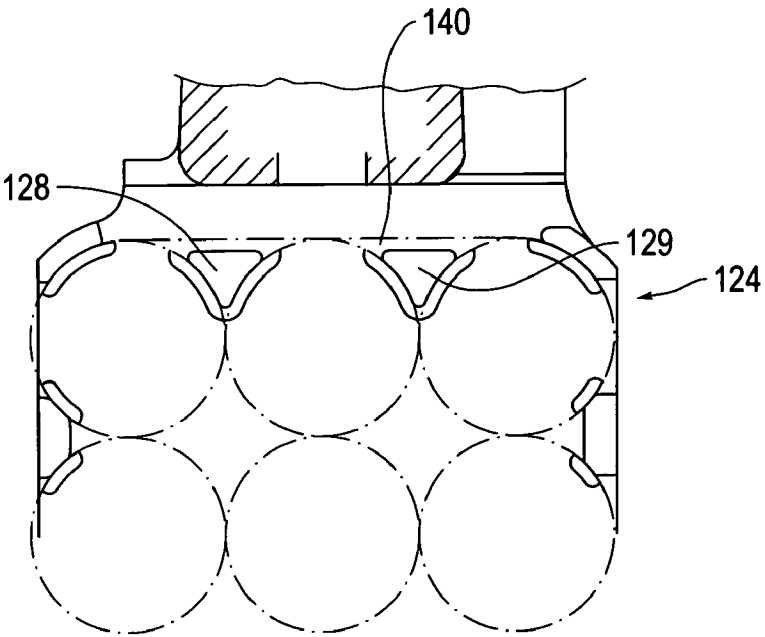
FIG. 10D is a cross-sectional view taken along line 10D—10D of the multi-purpose sideframe illustrated in FIG. 10C.
Figure 10C:
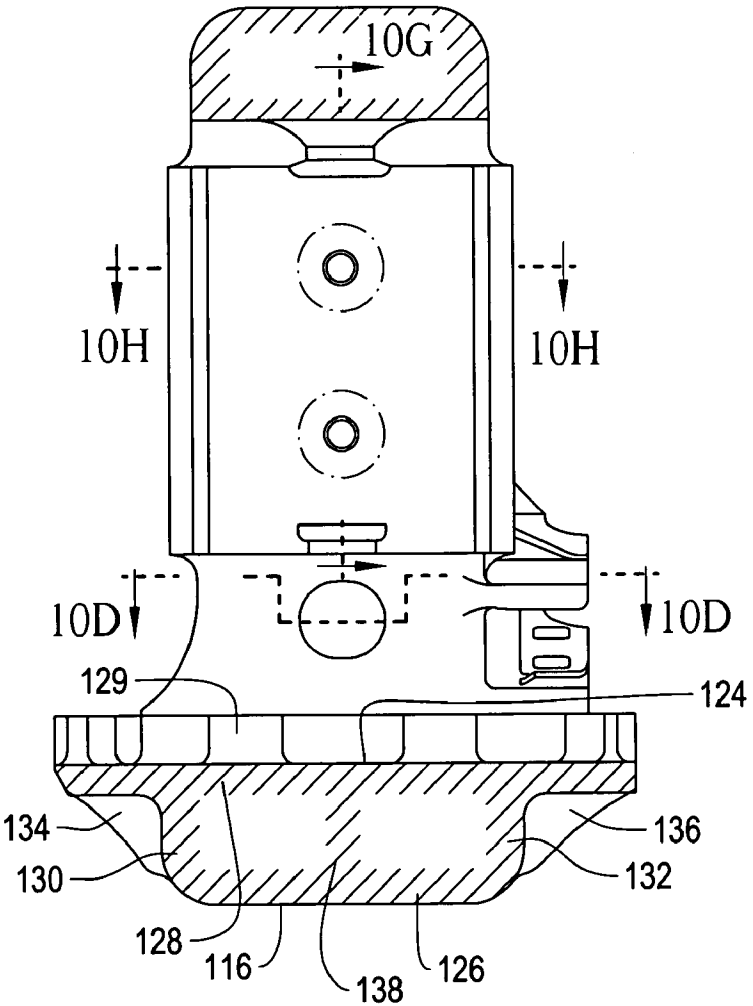
FIG. 10C is a cross-sectional view taken along line 10C—10C of the multi-purpose sideframe illustrated in FIG. 10B.
Figure 10E:
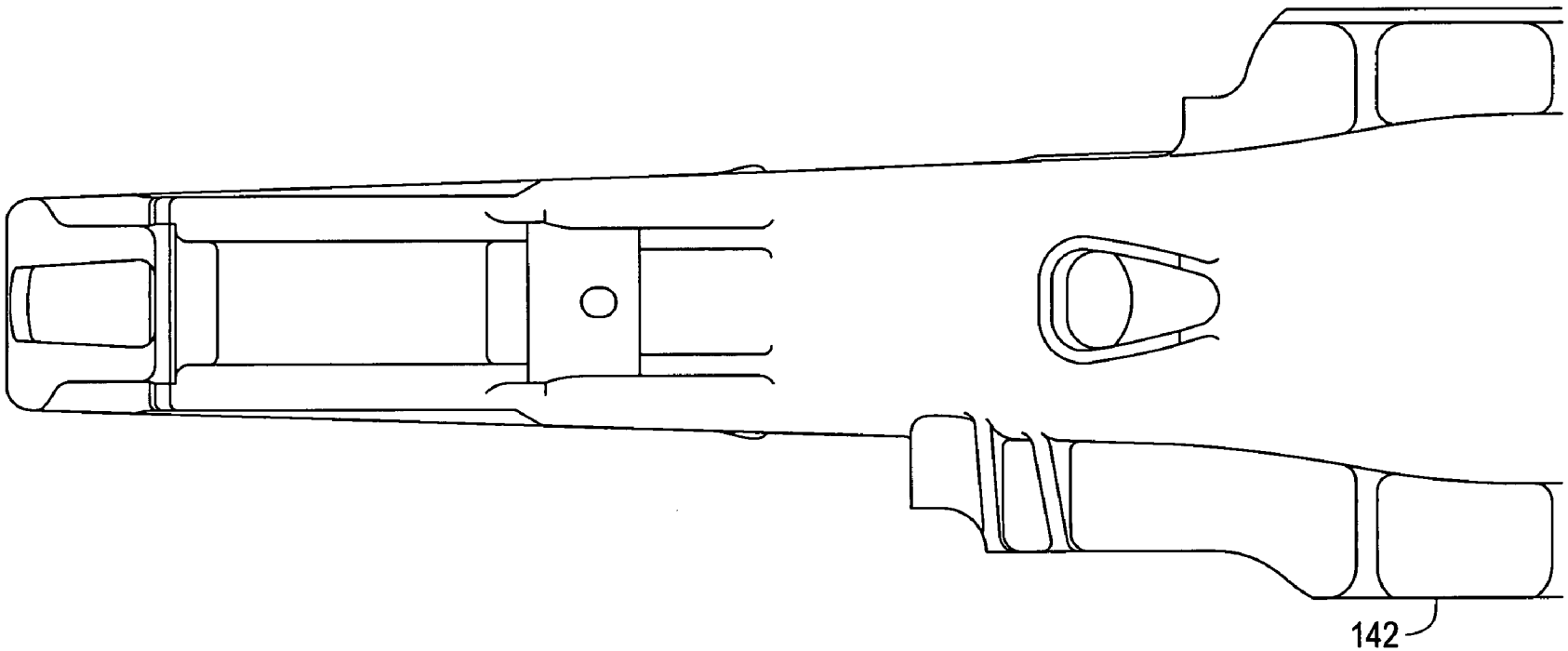
FIG. 10E is a partial bottom view of a multi-purpose sideframe.
Figure 10F:
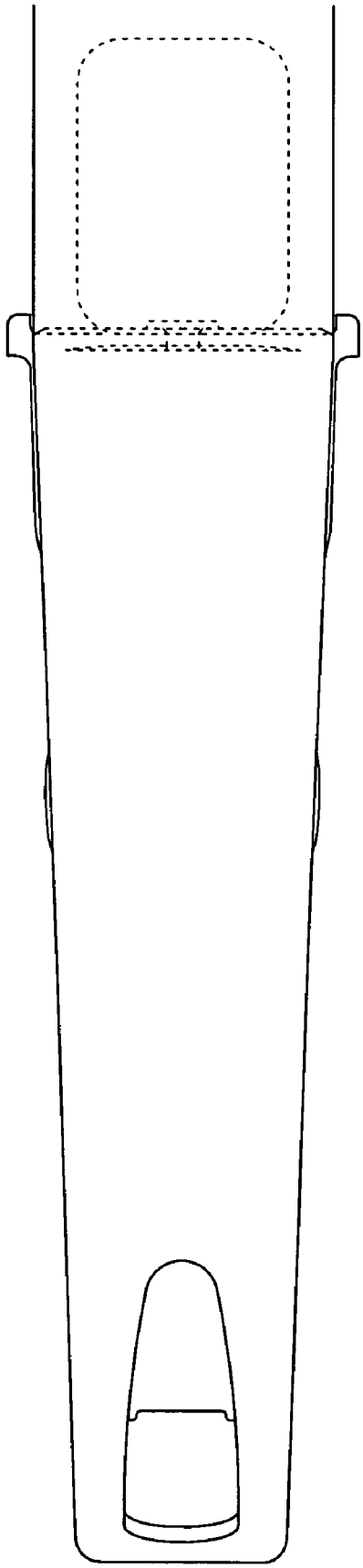
FIG. 10F is a partial top view a multi-purpose sideframe.
Figure 10H:
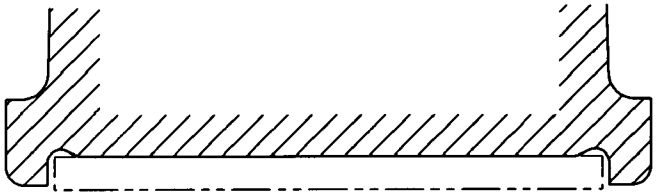
FIG. 10H is a cross-sectional view taken along line 10H—10H of the multi-purpose sideframe illustrated in FIG. 10C.
Figure 10I:
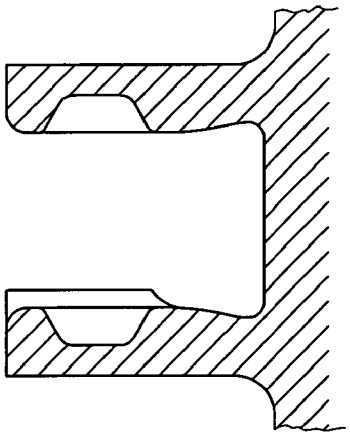
FIG. 10I is a cross-sectional view taken along line 10I—10I of the multi-purpose sideframe illustrated in FIG. 10J.
Figure 10G:
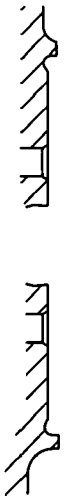
FIG. 10G is a cross-sectional view taken along line 10G—10G of the multi-purpose sideframe illustrated in FIG. 10C.
Figure 10K:
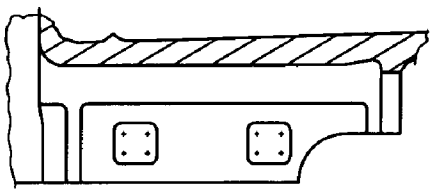
FIG. 10K is a cross-sectional view taken along line 10K—10K of the multi-purpose sideframe illustrated in FIG. 10J.
Figure 10J:
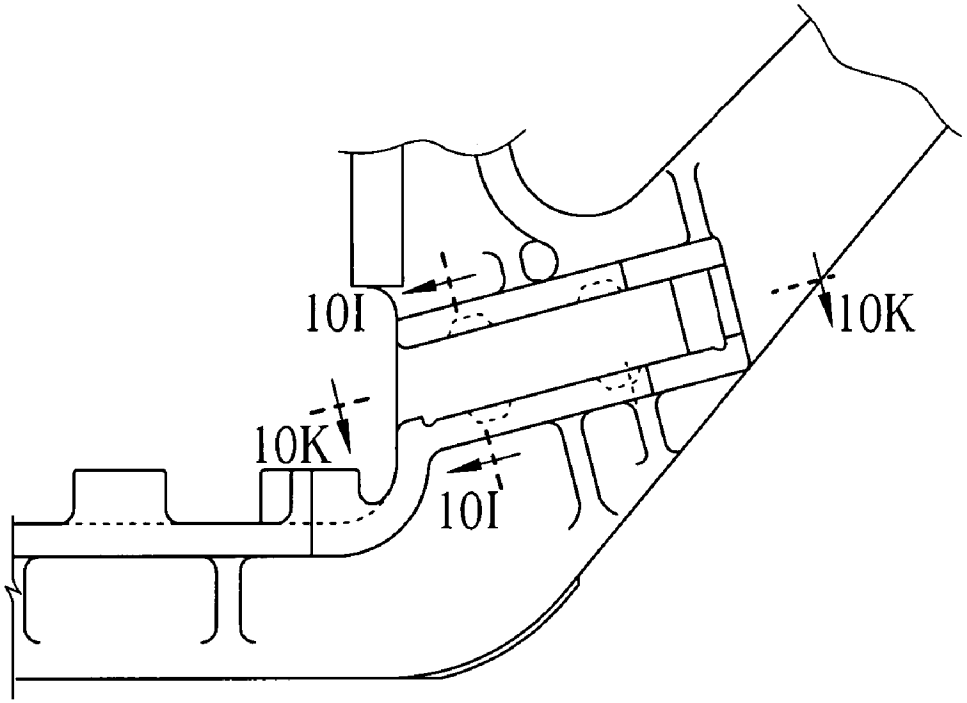
FIG. 10J is a partial side view of the multi-purpose sideframe.

Referring to FIG. 10A, a multi-purpose sideframe 100 is illustrated. The sideframe 100 is comprised of a longitudinal elongated top compression member 102 that runs longitudinally across the top part of the sideframe 100 and ends in end sections 104 and 106. A pedestal opening 108 is formed at a lower portion of end section 104 and a pedestal opening 110 is formed at a lower portion of end section 106. The pedestal openings 108 and 110 are each adapted to receive an axle therein, and may also be adapted to receive a resilient pedestal pad, such as, for example, an elastomeric pedestal pad (not shown) in addition to the axle. The pad, if present, is accommodated between the top surface of the axle and the bottom surface of the pedestal opening of the sideframe. The pedestal pad is fatigue resistant and allows more flexibility, thus reducing wheel to rail forces.

Diagonal tension members 112 and 114 extend downwardly from top compression member 102 at a point near end sections 104 and 106. The angle at which diagonal tension members 112 and 114 extend is about 45 degrees, but may vary accordingly. Bottom section 116 extends longitudinally and joins the lower end sections of diagonal tension members 112 and 114. Column members 118 and 120 are spaced longitudinally from each other and extend vertically from an upper portion 117 of bottom section 116 near its junction with diagonal tension members 112 and 114 to a lower surface 101 of top compression member 102. The combination of the lower portion 101 of top compression member 102, the upper portion 117 of bottom section 116 and column members 118 and 120 form a generally rectangular bolster opening 122. The upper surface 117 of bottom section 116 is also referred to as spring seat 124.

The sideframe 100 is preferably a unitary cast steel structure. Such structure may be cast in accordance with modern foundry practice that includes the use of cores to form the structural components of sideframe 100 in a generally hollow fashion such that each structural component, such as top compression member 102 and bottom section 116, are generally hollow, each comprised of a bottom section and a top section and two side sections joined to the top and bottom sections. An example suitable cast steel sideframe is described in U.S. Pat. No. 5,481,986 to Spencer et al. and is incorporated herein by reference.

Referring now to FIGS. 10A–10K of the drawings, the sideframe 100 is shown in greater detail with appropriate cross sectioning. Bottom section 116 comprises bottom wall 126 and top wall 128, the top surface of which acts as the spring seat 124. Spring retainers 129 extend upwardly from spring seat 124. Spring retainers 129 act to form a pattern wherein the cylindrical springs are received and positioned to support the bolster end. The spring retainers 129 have about 0.75 to 2.0 inches in height, and preferably 1.4 inches in height. Any number of spring retainers 129 may be used in any number of configurations. Accordingly, it is not intended that the drawings limit the number, size, shape or configuration of the spring retainers 129.

Bottom section 116 is also comprised of sidewalls 130 and 132 that extend vertically upward from bottom wall 126 to top wall 128 and form the longitudinal outer edges of bottom section 116. Support ribs 138 extend longitudinally within bottom section 116. Each of the support ribs 138 are spaced laterally and extend vertically from bottom wall 126 to top wall 128. Wall webs 134 and 136 extend from, respectively, wall 130 and 132 to intersect with an outer edge of top wall 128 thereby providing additional strength for spring seat 124.

The spring seat 124 is the bottom end of the generally rectangular bolster opening 122. The spring seat 124 extends about 20 inches between column members 118 and 120 and extends about 17 inches from a front face 140 of the sideframe 100 to a back face (not shown) of the sideframe 100. The area of the spring seat 124 may accommodate a number of different spring group configurations, such as, for example, a 9 outer coil—8 inner coil spring group, 9 outer coil—7 inner coil spring group, or the like.

Different spring group arrangements will require different amounts of space on the spring seat 124. For example, a spring group with smaller diameter control springs may not need the space provided by the spring seat 124. However, the spring seat 124 with the spring retainers 129 will still support the smaller diameter spring group because the springs are configured, with use of the spring retainers 129, such that movement of, for example, the center spring or the control spring, is allowable without compromising the integrity of the suspension system.

The sideframe 100 has protrusions 142 located against the column members 118 and 120 in the bolster opening 122. The protrusions 142 are about 0.25 inches thick. One of the protrusions 142 is located on the column member 118 about 6 inches from the upper portion 117 of the bottom section 116 of the bolster opening 122. Another of the protrusions 142 is located on the column member 118 about 1.3 inches from the lower surface 101 of top compression member 102 of the bolster opening 122. Protrusions 142 are similarly located on column member 120.

The bolster opening 122 extends about 18.4 inches from an upper portion 117 of bottom section 116 near its junction with diagonal tension members 112 and 114 to a lower surface 101 of top compression member 102. The bolster opening 122, in an area below the protrusions 142, extends about 20 inches between column members 118 and 120; and in an area between the protrusions, extends about 18.5 inches between the column members 118 and 120.

Column wear plates 144 are secured to the column members 118 and 120, between the protrusions 142, respectively. The column wear plates 144 have a thickness of about 0.5 inch, a length of about 10.4 inches, and a width of about 8.5 inches. The bolster opening 122 has been widened and lengthened to accept the newly designed, about 0.5 inch thick and about 10.4 inch height, column wear plates 144. The bolster opening may accommodate wear plates ranging in length between 9.4 inches to 10.4 inches, preferably 10.4 inches in length.

The width of the bolster opening between the column wear plates of a typical sideframe is sized to fit a standard bolster end and a specific friction shoe assembly. Friction shoe assemblies and springs are limited to the height of the bolster opening 122. For example, if maintenance of a spring shoe assembly is required, for example, by replacing a spring, the spring would need to be replaced by a spring of the same height. The typical free height of control springs used with known friction shoe designs may vary from 11.5 inches to 12.69 inches. However, the sideframe of the present invention may accept springs having a free height from 10 inches to 13 inches. A longer spring, for example, would result in the friction shoe sitting too high in the bolster window or not properly fitting inside the bolster window. The present invention, however, has a heightened wear plate to permit use of longer or shorter springs to accommodate both shorter and longer springs and to further not limit the suspension design by use of a particular spring height.

Heightening the column wear plates alone is not enough to accommodate various suspension designs. For example, simply lengthening the bolster opening to accommodate longer or shorter springs would not necessarily be sufficient to accommodate a typical bolster, i.e., the bolster may no longer fit into the opening. In order to accommodate the bolster and various spring group and friction shoe assemblies, the universal sideframe window also has a uniquely longer length and width to accommodate the wear plates, without taking away from the length or width required for the spring group or shoe assemblies, such that the bolster can still fit in the bolster opening.

More specifically, the height of the column wear plates 144 of the present invention represent an increase of about 1 inch in height over the column wear plates 144, or friction surface of the prior art. This change in height allows the sideframe 100 to accommodate the vertical travel of various designs of friction shoes. For example, the increased height in the column wear plates 144 can accommodate longer or shorter springs as well as different size friction shoes, and, thus, a larger range of suspension systems. Further, the increased size of the spring seat 124 allows the sideframe 100 of the present invention to accommodate various spring group assemblies; thereby allowing use of the same sideframe 100 for various freight truck car suspension designs. The sideframe 100 of the present invention may be used with a variety of freight car truck suspension systems regardless of the style of the spring group, bolster and friction shoe used therewith. It is noted that the height of the column wear plates may be varied and the dimensions of the bolster opening of the sideframe may correspondingly be varied without departing from the scope of the present invention.

With this universal sideframe 100, individual springs or spring groups can readily be switched if desired to accommodate different railcars or use of the railcars without replacing the entire sideframe 100. Changes may be made without having to obtain whole new truck sideframes and springs. Further, if a new spring system is developed, the existing universal sideframe 100 may be able to employ the new spring system.

Specifically, the spring seat 124 of the bolster opening 18 of the universal sideframe 100 allows for various springs and spring group sizes. Smaller spring groups are accommodated as well. Although it may be thought that a smaller spring group in the larger spring seat 124 may permit too much shifting of the springs within the assembly, this shifting in fact is not problematic. The outer springs are held in place by the spring retainers 129 and movement of the center spring(s) is permissible.

In addition to being able to readily change the springs or the spring groups, the friction shoe assemblies and the bolster may be readily changed as well without having to change the existing universal sideframe 100. As described above, the lengthened column wear plates 144 and correspondingly lengthened bolster opening 18 allows for friction shoes, bolsters and spring assemblies of varying dimensions.

Those skilled in the art will recognize that certain variations and/or additions can be made in these illustrative embodiments. It is apparent that various alternatives and modifications to the embodiments can be made thereto. It is, therefore, the intention in the appended claims to cover all such modifications and alternatives as may fall within the true scope of the invention.

What is claimed is:

1. A sideframe for a rail car wheel-truck assembly supporting a rail car having a load, the sideframe comprising:

a top member having opposing end sections wherein the top member forms a top part of the sideframe;

a bolster opening in the sideframe, the bolster opening defined by the top member, a bottom platform, and two opposing column sides extending vertically from the bottom platform to the top member;

column wear plates secured to each of the two opposing column sides inside the bolster opening, wherein the column wear plates have a height ranging between about 9.4 inches and about 10.4 inches;

wherein the sideframe is able to accommodate therein:

a spring group supported by the bottom platform; and a plurality of spring shoe assemblies wherein the bolster opening accepts a bolster end supported by the spring group and the plurality of spring shoe assemblies, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car.

2. The sideframe of claim 1, wherein the sideframe is a unitary cast steel structure.

3. A sideframe for a rail car wheel-truck assembly supporting a rail car having a load, the sideframe comprising:

a top member having opposing end sections wherein the top member forms a top part of the sideframe;

a bolster opening in the sideframe, the bolster opening defined by the top member, a bottom platform, and two opposing column sides extending vertically from the bottom platform to the top member;

column wear plates secured to each of the two opposing column sides inside the bolster opening, wherein the column wear plates have a height of about 10 inches;

wherein the sideframe is able to accommodate therein:

a spring group supported by the bottom platform; and a plurality of spring shoe assemblies wherein the bolster opening accepts a bolster end supported by the spring group and the plurality of spring shoe assemblies, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car.

4. A sideframe for a rail car wheel-truck assembly supporting a rail car having a load, the sideframe comprising:

a top member having opposing end sections wherein the top member forms a top part of the sideframe;

a bolster opening in the sideframe, the bolster opening defined by the top member, a bottom platform, and two opposing column sides extending vertically from the bottom platform to the top member, wherein the bolster opening, in an area in which the bolster opening houses the bolster, extends about 17.5 inches between the column wear plates;

column wear plates secured to each of the two opposing column sides inside the bolster opening;

wherein the sideframe is able to accommodate therein:

a spring group supported by the bottom platform; and a plurality of spring shoe assemblies wherein the bolster opening accepts a bolster end supported by the spring group and the plurality of spring shoe assemblies, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car.

5. A sideframe for a rail car wheel-truck assembly supporting a rail car having a load, the sideframe comprising:

a top member having opposing end sections wherein the top member forms a top part of the sideframe;

a bolster opening in the sideframe, the bolster opening defined by the top member, a bottom platform, and two opposing column sides extending vertically from the bottom platform to the top member, wherein the bolster opening extends about 18.4 inches from the top member to the bottom platform;

wherein the sideframe is able to accommodate therein:

a spring group supported by the bottom platform; and a plurality of spring shoe assemblies wherein the bolster opening accepts a bolster end supported by the spring group and the plurality of spring shoe assemblies, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car.

6. A sideframe for a rail car wheel-truck assembly supporting a rail car having a load, the sideframe comprising:

a top member having opposing end sections wherein the top member forms a top part of the sideframe;

a bolster opening in the sideframe, the bolster opening defined by the top member, a bottom platform, and two opposing column sides extending vertically from the bottom platform to the top member, wherein the bolster opening extends about 20 inches between the two opposing column sides;

wherein the sideframe is able to accommodate therein:

a spring group supported by the bottom platform; and a plurality of spring shoe assemblies wherein the bolster opening accepts a bolster end supported by the spring group and the plurality of spring shoe assemblies, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car.

7. A sideframe for a rail car wheel-truck assembly supporting a rail car having a load, the sideframe comprising:

a top member having opposing end sections wherein the top member forms a top part of the sideframe;

a bolster opening in the sideframe, the bolster opening defined by the top member, a bottom platform, and two opposing column sides extending vertically from the bottom platform to the top member, wherein the bolster opening, in an area in which the bolster opening houses the bolster, extends about 18.5 inches between the each of the two opposing column sides;

wherein the sideframe is able to accommodate therein:

a spring group supported by the bottom platform; and a plurality of spring shoe assemblies wherein the bolster opening accepts a bolster end supported by the spring group and the plurality of spring shoe assemblies, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car.

8. A sideframe for a rail car wheel-truck assembly supporting a rail car having a load, the sideframe comprising:

a top member having opposing end sections wherein the top member forms a top part of the sideframe;

a bolster opening in the sideframe, the bolster opening defined by the top member, a bottom platform, and two opposing column sides extending vertically from the bottom platform to the top member, wherein an area of the bolster opening, housing the bolster, extends about 17.5 inches in a horizontal direction and about 10 inches in a vertical direction;

wherein the sideframe is able to accommodate therein:

a spring group supported by the bottom platform; and a plurality of spring shoe assemblies wherein the bolster opening accepts a bolster end supported by the spring group and the plurality of spring shoe assemblies, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car.

9. A sideframe for a rail car wheel-truck assembly supporting a rail car having a load, the sideframe comprising:

a top member having opposing end sections wherein the top member forms a top part of the sideframe;

a bolster opening in the sideframe, the bolster opening defined by the top member, a bottom platform, and two opposing column sides extending vertically from the bottom platform to the top member;

wherein the sideframe is able to accommodate therein:

a spring group supported by the bottom platform; and a plurality of spring shoe assemblies wherein the bolster opening accepts a bolster end supported by the spring group and the plurality of spring shoe assemblies;

a control spring for each of the plurality of shoe assemblies, wherein the control spring ranges in height from about 10 inches to about 13 inches, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car.

10. The sideframe of claim 9, further comprising:

a pedestal opening formed in each of the opposing end sections of the top member.

11. The sideframe of claim 10, wherein the pedestal opening is capable of receiving a resilient pedestal pad of varying designs, and sizes, in addition to an axle.

12. The sideframe of claim 9, further comprising:

a spring seat in the bolster opening defined by an upper surface of the bottom platform.

13. The sideframe of claim 12, further comprising:

a plurality of spring retainers extending upwardly from the spring seat.

14. A method of repairing or maintaining a sideframe for a rail car wheel-truck assembly supporting a rail car having a load, the sideframe comprising a top member having opposing end sections wherein the top member forms a top part of the sideframe; a bolster opening in the sideframe, the bolster opening defined by the top member, a bottom platform, and two opposing column sides extending vertically from the bottom platform to the top member; wherein the sideframe is able to accommodate therein: a spring group supported by the bottom platform and a plurality of spring shoe assemblies wherein the bolster opening accepts a bolster end supported by the spring group and the plurality of spring shoe assemblies a control spring for each of the plurality of shoe assemblies, wherein the control spring ranges in height from about 10 inches to about 13 inches, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car, the method comprising:

providing a sideframe having a bolster opening formed by the combination of a top member, a bottom platform and at least two column members;

wherein the bolster opening accepts a bolster end and a plurality of spring shoe assemblies between the bolster end and column wear plates, and further wherein a spring group is supported by the bottom platform in the bolster opening; and replacing a spring from the spring group and/or one of the plurality of spring shoe assemblies with a same type of spring or with a different type of spring and enabling replacement therewith while accommodating the load of the rail car or a different load of the rail car.

15. The method of claim 14, further comprising the step of:

changing the configuration of the spring group.

16. The method of claim 14, further comprising:

providing column wear plates secured to each of the two opposing column sides inside the bolster opening;

wherein the bolster end is of a variety of different design, or size, and further wherein a spring group is supported by the bottom platform in the bolster opening.

17. A method of repairing or maintaining a sideframe for a rail car wheel-truck assembly supporting a rail car having a load, the sideframe comprising a top member having opposing end sections wherein the top member forms a top part of the sideframe; a bolster opening in the sideframe, the bolster opening defined by the top member, a bottom platform, and two opposing column sides extending vertically from the bottom platform to the top member; column wear plates secured to each of the two opposing column sides inside the bolster opening, wherein the column wear plates have a height ranging between about 9.4 inches and about 10.4 inches, wherein the sideframe is able to accommodate therein: a spring group supported by the bottom platform; and a plurality of spring shoe assemblies wherein the bolster opening accepts a bolster end supported by the spring group and the plurality of spring shoe assemblies, wherein the plurality of spring shoe assemblies are located in the bolster and adjacent the two opposing column sides, and further wherein the spring group and the plurality of spring shoe assemblies are respectively interchangeable with different spring groups and different spring shoe assemblies of varying design, or size and thereby enable replacement therewith while accommodating the load of the rail car or a different load of the rail car;

the method comprising:

providing a sideframe having a bolster opening formed by the combination of a top member, a bottom platform and at least two column members;

wherein the bolster opening accepts a bolster end and a plurality of spring shoe assemblies between the column wear plates, and further wherein a spring group is supported by the bottom platform in the bolster opening; and replacing one of the plurality of spring shoe assemblies with a similar or different spring shoe assembly and enabling replacement therewith while accommodating the load of the rail car or a different load of the rail car.

18. A sideframe for a rail car wheel-truck assembly supporting a rail car, the sideframe comprising:

a top member having opposing end sections wherein the top member forms a top part of the sideframe;

a bolster opening in the sideframe, the bolster opening defined by the top member, a bottom platform, and two opposing column sides extending vertically from the bottom platform to the top member, wherein the bolster opening has an area to accommodate the bolster and further wherein the area to accommodate the bolster in the bolster opening is about 17.5 inches in width and about 11 inches in height;

column wear plates secured to each of the two opposing column sides inside the bolster opening wherein the sideframe is able to accommodate therein:

a spring group supported by the bottom platform; and a plurality of spring shoe assemblies wherein the bolster opening accepts a bolster end supported by the spring group and the plurality of spring shoe assemblies, wherein the plurality of spring shoe assemblies are located in the bolster and adjacent the two opposing column sides, and further wherein the bolster, the spring group and the plurality of spring shoe assemblies are respectively interchangeable with different bolsters, different spring groups and different spring shoe assemblies of varying design, or size.

* * * * *